US007185790B2

(12) United States Patent
Weiler

(10) Patent No.: US 7,185,790 B2
(45) Date of Patent: Mar. 6, 2007

(54) HERMETICALLY SEALED CONTAINER WITH NON-DRIP OPENING

(75) Inventor: Gerhard H. Weiler, Woodstock, IL (US)

(73) Assignee: Weiler Engineering, Inc., Elgin, IL (US)

( * ) Notice: Subject to any disclaimer, the term of this patent is extended or adjusted under 35 U.S.C. 154(b) by 335 days.

(21) Appl. No.: 10/393,309

(22) Filed: Mar. 20, 2003

(65) Prior Publication Data

US 2004/0182883 A1 Sep. 23, 2004

(51) Int. Cl.
*B67B 5/00* (2006.01)

(52) U.S. Cl. ..... 222/153.07; 222/153.06; 222/541.6; 222/541.9

(58) Field of Classification Search ..... 222/541.5, 222/541.6, 153.06–153.07, 213–215, 541.9, 222/95, 107; 215/253–254
See application file for complete search history.

(56) References Cited

U.S. PATENT DOCUMENTS

| | | | | | |
|---|---|---|---|---|---|
| 4,408,700 | A * | 10/1983 | Fillmore et al. | ..... | 222/153.06 |
| 4,502,616 | A * | 3/1985 | Meierhoefer | ..... | 222/215 |
| 4,566,613 | A * | 1/1986 | Anscomb | ..... | 222/541.9 |
| 4,979,630 | A * | 12/1990 | Rose et al. | ..... | 215/47 |
| 5,121,856 | A * | 6/1992 | Weiler et al. | ..... | 222/209 |
| 5,735,401 | A * | 4/1998 | Cassou et al. | ..... | 206/469 |
| 5,839,609 | A * | 11/1998 | Zakensberg | ..... | 222/107 |
| 5,901,865 | A * | 5/1999 | Weiler et al. | ..... | 215/48 |
| 6,068,148 | A * | 5/2000 | Weiler | ..... | 215/48 |
| 6,619,516 | B2 * | 9/2003 | Weiler et al. | ..... | 222/420 |
| 6,626,308 | B2 * | 9/2003 | Weiler | ..... | 215/48 |

* cited by examiner

*Primary Examiner*—Frederick C. Nicolas
(74) *Attorney, Agent, or Firm*—Olson & Hierl, Ltd.

(57) ABSTRACT

A hermetically sealed container having a nozzle that defines a dispensing orifice closed by a unitary but removable cap. Accumulation of container contents in the cap is minimized by a constriction in the nozzle situated at least 0.1 inches from the dispensing orifice.

14 Claims, 3 Drawing Sheets

HERMETICALLY SEALED CONTAINER WITH NON-DRIP OPENING

FIELD OF THE INVENTION

The invention relates to hermetically sealed thermoplastic ampoules or containers and, more particularly, to an improved, non-dripping opening and optionally reclosable, dispensing nozzle therefor.

BACKGROUND OF THE INVENTION

Hermetically sealed thermoplastic containers or ampoules of the type disclosed in, for example, U.S. Pat. No. 5,901,865 to Weiler et al. are well known in the art and are characterized in that a removable cap or closure is delineated by a frangible web and is adapted to be twisted off from a dispensing nozzle to allow the fluid contents to be dispensed through the nozzle. However, because some of the ampoule contents has a tendency to become trapped and suspended in the cap, the contents sometimes drips or is splashed about the container when the cap is twisted off the nozzle.

The present invention is directed to a hermetically sealed container incorporating a nozzle closure configured to eliminate the retention therein of any portion of the container contents, thus effectively eliminating any dripping or splashing upon removal of the cap.

SUMMARY OF THE INVENTION

The hermetically sealed container of the present invention has a dispensing nozzle with a dispensing orifice thereof sealed by a unitary but removable hollow cap. A constriction is provided in the nozzle downstream from the dispensing aperture and avoids product accumulation in the cap. The constriction is characterized in that the length thereof is less than the length of the nozzle portions upstream and downstream from the constriction.

The ratio of the nozzle inside diameter to the constriction inside diameter is in the range of about 4:1 to about 15:1, respectively, depending in part on the viscosity of the product contents to be dispensed. The constriction is spaced from the dispensing orifice by at least about 0.1 inches. The length of the constriction is also dependent in part on the viscosity of the product to be dispensed, and is at least equal to one inside diameter of the constriction.

In a preferred embodiment, the inside diameter of the constriction is in the range of about 0.01 to about 0.06 inches, and the inside diameter of the nozzle in the range of about 0.125 to about 0.25 inches. For constrictions having an inside diameter in the foregoing range, the constriction is about 0.06 to about 0.1 inches long.

Other features and advantages of the present invention will become readily apparent from the following detailed description, the appended drawings and the accompanying claims.

BRIEF DESCRIPTION OF THE DRAWINGS

In the accompanying drawings forming part of the specification and in which like numerals are employed to designate like parts throughout the same.

DETAILED DESCRIPTION OF THE PREFERRED EMBODIMENTS

Figure 1:
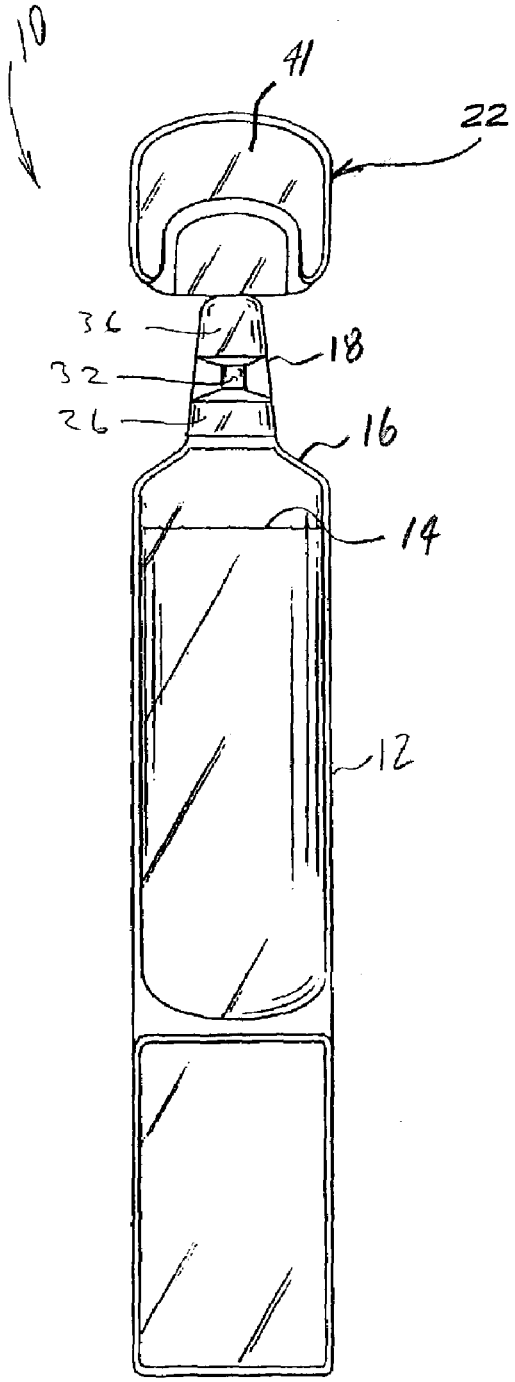
FIG. 1 is a front elevational view of an ampoule or container incorporating the nozzle of the present invention.

The invention disclosed herein is, of course, susceptible of embodiment in many different forms. Shown in the drawings and described herein below in detail are preferred embodiments of the invention. It is to be understood, however, that the present disclosure is an exemplification of the principles of the invention and does not limit the invention to the illustrated embodiments.

For ease of description, the container of the present invention is described herein below with reference to the container in its usual vertical upright orientation and terms such as upper, lower, vertical, horizontal, etc., will be used herein with reference to this usual position.

Moreover, it is understood that the FIGS. herein do not necessarily show details of the container or the nozzle thereof that are known in the art and that will be recognized by those skilled in the art as such. The detailed descriptions of these elements of the container and nozzle are not necessary to an understanding of the invention. Accordingly, such elements are herein represented only to the degree necessary to aid in an understanding of the features of the present invention.

Figure 2:
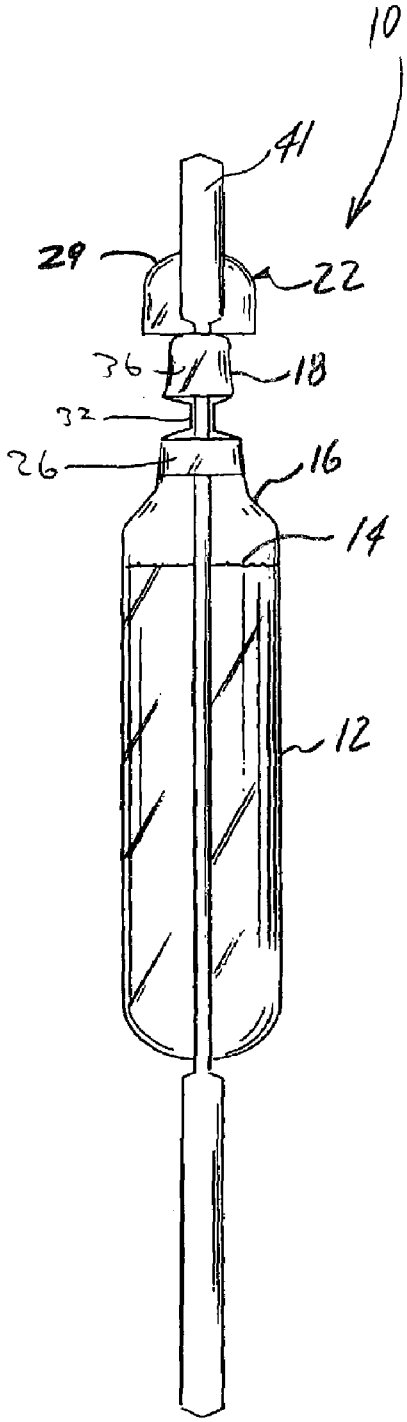
FIG. 2 is a side elevational view of the ampoule of FIG. 1.
Figure 3:
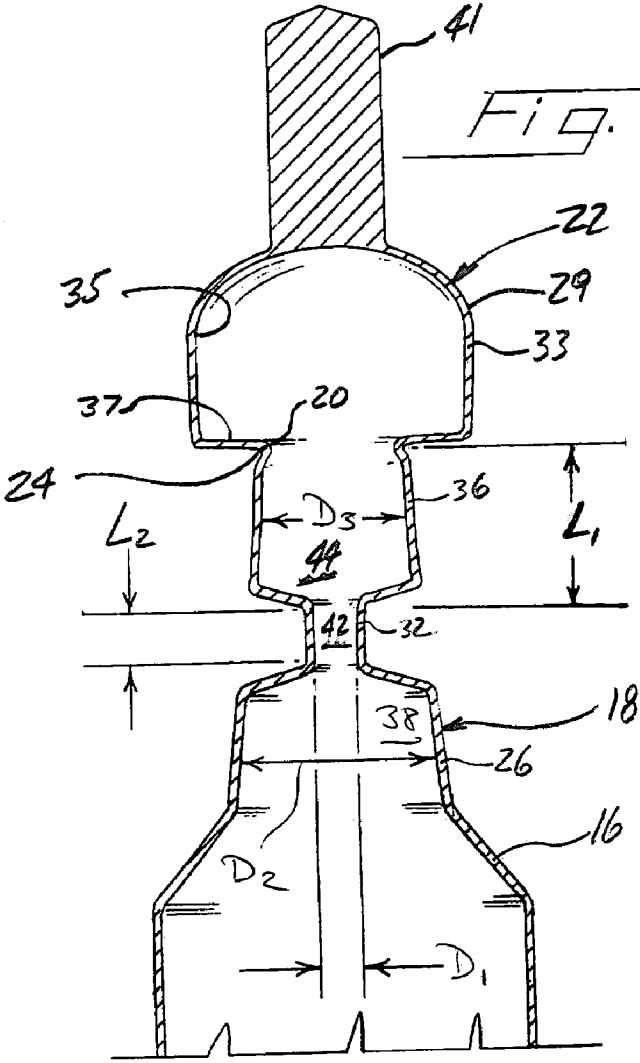
FIG. 3 is an enlarged, fragmentary vertical cross-sectional view of the nozzle and cap portions of the ampoule of FIG. 1.

An article in accordance with the teachings of the present invention is illustrated in FIGS. 1–3 in the form of a molded thermoplastic container or ampoule 10 which may be fabricated by the well-known blow/fill/seal technique such as, for example, the technique shown and disclosed in U.S. Pat. No. 4,671,763 to Weiler.

The molded thermoplastic material can be a conventional molding grade thermoplastic material such as high density polyethylene, low density polyethylene, polypropylene, and the like, compatible with the contemplated container contents. It is understood, of course, that containers or ampoules embodying the nozzle of the present invention can have a wide variety of shapes and capacities.

The container 10 shown in FIGS. 1 and 2 includes a body portion 12 defining a reservoir configured to house a liquid contents 14, a neck portion 16 unitary with the body portion 12, a unitary nozzle 18 extending in a direction away from the neck portion 16 and terminating at upper end in a dispensing opening or orifice 20 (FIG. 3). Nozzle 18 is provided with a constricted wall portion or constriction 42 between upstream nozzle portion 26 and downstream nozzle portion 36. A hollow, removable twist-off cap or closure 22 occludes the orifice 20 and is unitary with the nozzle 18. The orifice 20 is delineated from the cap 22 by a frangible web 24 (FIG. 3). Preferably cap 22 is configured so that it can seat on the distal end portion of nozzle 18 after initial removal so as to provide a reclosure feature.

Referring specifically to FIG. 3, the hollow cap or closure 22 includes a dome 29 defined by a circumferentially extending wall 33 which, in turn, defines a hollow interior cap portion 35 and a generally horizontal circumferentially extending base wall 37 unitary with frangible web 24 that circumscribes orifice 20. A grip tab 41 extends unitarily upwardly from the top of the dome shaped wall 33 for facilitate twist-off of cap 22 when the contents 14 of container 10 is to be dispensed.

The nozzle 18 comprises an upstream portion 26 extending upwardly from the container neck portion 16, a constriction 42, and downstream portion 36. The downstream portion 36 terminates at the frangible web 24. Constriction 42 is defined by cylindrical wall portion 32.

The nozzle portions 26 and 36, respectively, together define an interior fluid ingress passageway or chamber 38 in fluid flow communication with the fluid passageway defined by the neck portion 16 which, in turn, is in fluid flow communication with the fluid reservoir defined by the container body portion 12.

The cylindrical wall portion 32 defines constriction 42 which is in fluid flow communication with the fluid ingress passageway 38.

Length $L_1$ of the downstream portion 36 and thus the upper chamber 44 is preferably greater than the inside diameter $D_1$ of the constriction 42. Preferably, the length $L_1$ is at least is about 0.1 inches (about 2.54 mm) while the constriction 42 has a width $D_1$ of about 0.01 to about 0.06 inches (about 0.254 mm to about 1.524 mm). The constriction 42 has a length $L_2$ of about 0.06 to about 0.1 inches (about 1.524 mm to about 2.54 mm) depending upon the viscosity of the product contained in the ampoule 10. The interior fluid ingress passageway 38 of upstream nozzle portion 26 preferably has an inside diameter of about 0.125 to about 0.25 inches (about 3.17 mm to about 6.35 mm). Likewise, the interior fluid egress passageway 44 defined by downstream nozzle portion 36 has an inside diameter of about 0.125 to about 0.25 inches (about 3.17 mm to about 6.35 mm). The length of each of the nozzle portions 26 and 36, respectively, is about twice the length of the wall portion 32 that defines constriction 42.

Although not shown in any of the FIGS. as a result of the normal handling of the ampoule 10, a portion of the product within the container body 12 may travel through the nozzle 18 and be retained within the cap 22.

However, in accordance with the present invention, the generally "hourglass" configuration of nozzle 18 and, more particularly, the configuration, size, and placement of the plurality of the nozzle walls defining the same causes any liquid which travels into the nozzle 18 is kept from accumulating in cap 22. The absence of any liquid in the hollow portion 35 of cap 22 eliminates or at least substantially minimizes any splashing of the container contents upon rupture of the frangible web 24 while opening the container.

Figure 4:
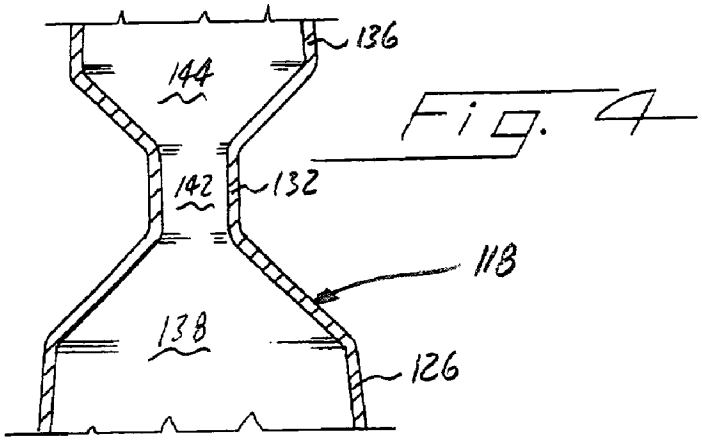
FIG. 4 is an enlarged, fragmentary vertical cross-sectional view of another embodiment of the nozzle of the present invention.

FIG. 4 depicts an alternate nozzle embodiment 118 including a lower interior nozzle chamber or passageway 138 defined by upstream nozzle portion 126 extending unitarily convergingly upwardly from the ampoule neck portion (not shown) and terminating in a second frustoconically shaped downstream nozzle portion 136 converging upwardly and unitarily inwardly at an angle of about 45 degrees relative to the nozzle portion 126. A third cylindrical circumferential nozzle portion 132 defines constriction 142 is situated therebetween. Upper interior nozzle chamber or passageway 144 defined by downstream nozzle portion 136 which extends unitarily divergingly upwardly from the upper end of the cylindrical wall portion 132 at an angle of about 45 degrees relative to the wall portion 132 and terminates at the frangible web (not shown) that delineates a removable cap.

Figure 5:
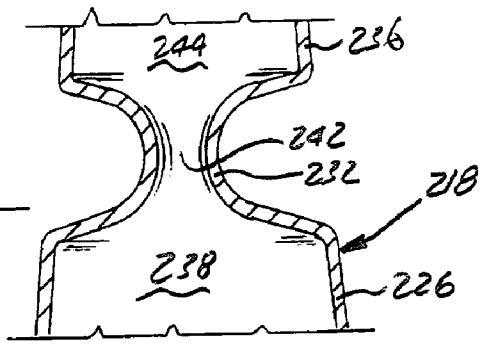
FIG. 5 is an enlarged, fragmentary vertical cross-sectional view of yet a further embodiment of the nozzle of the present invention.

FIG. 5 depicts a yet further nozzle embodiment 218 which includes constriction 242 defined by arched nozzle arched portion 272. Upstream interior nozzle passageway or chamber 238 is defined by upstream nozzle portion 226 which extends upwardly from the ampoule neck portion (not shown), and downstream interior nozzle passageway or chamber 244 is defined by downstream nozzle portion 236 which extends upwardly from the constriction 242 inwardly concavely shaped or arched nozzle portion 232 and terminating in the frangible web (not shown).

Figure 6:
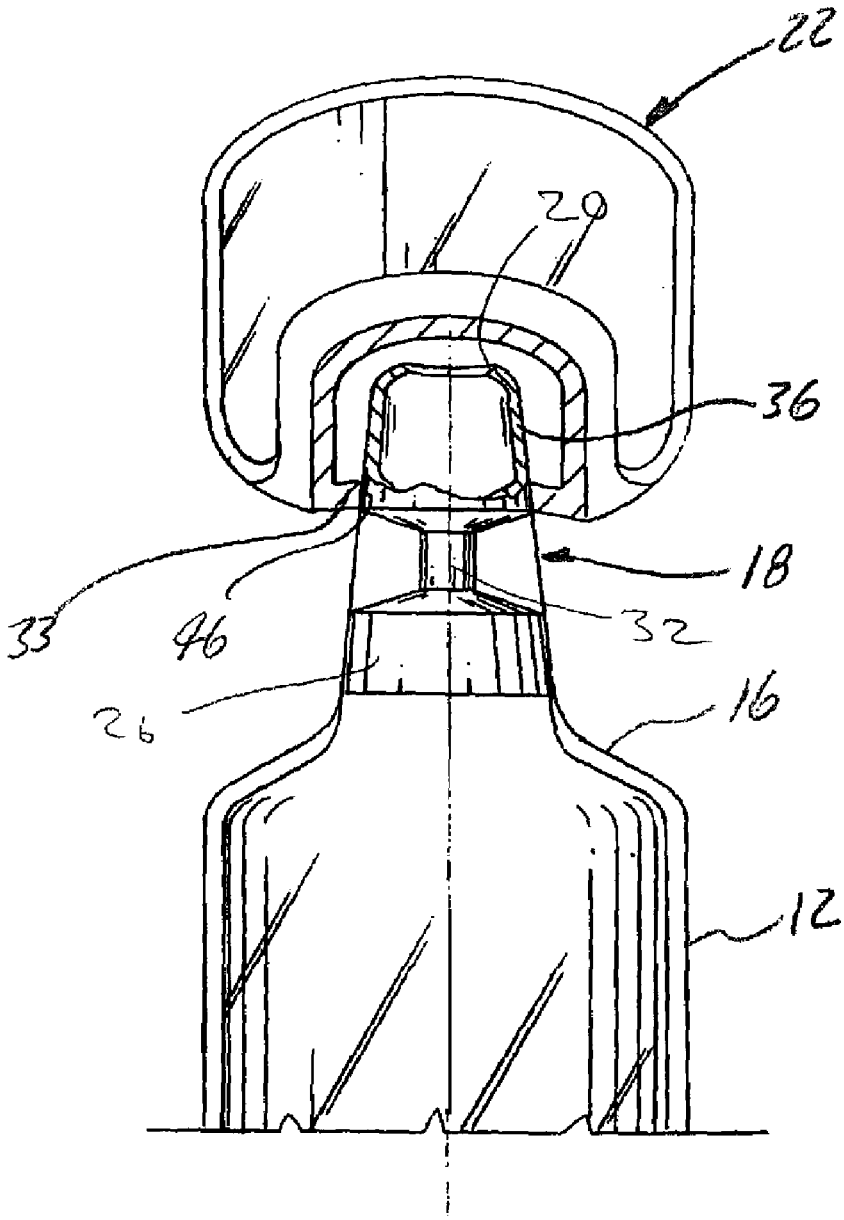
FIG. 6 is an enlarged, fragmentary view of the ampoule of FIGS. partly in section 1 and 2, with the cap secured over the nozzle after initial removal.

FIG. 6 depicts the container 10 of FIGS. 1–3 after the cap 22 has been twisted off nozzle 18 at the frangible web 24 and then subsequently seated over the nozzle 18 to reclose orifice 20. The overcap 22 is removably sealed and secured over the nozzle 18 in a relationship wherein the free circumferential edge 46 of the horizontal base wall 33 of the cap 22 is in abutting frictional sealing engagement with the outer surface of the wall 36 that defines the nozzle 18. As such, the base wall 33 of cap 22 provides a liquid tight seal between the nozzle 18 and the cap 22.

The foregoing description of the invention is illustrative. Numerous variations and modifications may be effected without departing from the true spirit and scope of the novel concepts or principles of this invention.

I claim:

1. A hermetically sealed thermoplastic container provided with a dispensing nozzle having upstream and downstream portions spaced from each other by a constriction, the downstream portion terminating in a dispensing orifice sealed by a unitary but removable cap; the constriction being spaced at least 0.1 inches from the orifice and the ratio of nozzle inside diameter to constriction inside diameter being in the range of about 4:1 to about 15:1.

2. The container of claim 1 wherein the inside diameter of the constriction is in the range of about 0.01 to 0.06 inches and the inside diameter of the nozzle portions adjacent, the constriction is about 0.125 to about 0.25 inches.

3. The container of claim 1 wherein the downstream portion of the nozzle is longer than the inside diameter of the constriction.

4. The container of claim 1 wherein the constriction is defined by converging walls of the nozzle.

5. The container of claim 1 wherein the upstream and the downstream portions of the dispensing nozzle have a generally frustoconical shape.

6. The container of claim 1 wherein the upstream and downstream portions of the dispensing nozzle comprise spaced-apart portions of a generally frustoconical shape, separated by the constriction.

7. The container of claim 4 wherein the constriction is defined by a cylindrical wall portion of the nozzle.

8. The container of claim 4 wherein the constriction is defined by a curvilinear wall portion of the nozzle.

9. A hermetically sealed thermoplastic container including a nozzle having upstream and downstream portions spaced from each other by a constriction and a unitary cap about a dispensing orifice defined by the downstream portion, removably secured to the downstream portion of the nozzle, the downstream portion spacing the constriction from the orifice by a distance of at least 0.1 inch.

10. The container of claim 9 wherein the inside diameter of the constricted passage is in the range of about 0.01 to about 0.06 inches.

11. The container of claim 9 wherein the constriction is about 0.06 to about 0.1 inches long.

12. The container of claim 9 wherein the constriction is defined by a cylindrical wall portion of the nozzle.

13. The container of claim 9 wherein the constriction is defined by a curvilinear wall portion of the nozzle.

14. A hermetically sealed thermoplastic container provided with a dispensing nozzle having upstream and downstream portions spaced from each other by a constriction, the downstream portion terminating in a dispensing orifice sealed by a unitary but removable cap having constriction in the nozzle; the constriction being spaced at least 0.1 inches from the orifice, the upstream and downstream portions of the dispensing nozzle comprising spaced-apart portions of a generally frustoconical shape, separated by the constriction.

* * * * *